US005435751A

United States Patent [19]

Papenheim et al.

[11] Patent Number: 5,435,751

[45] Date of Patent: Jul. 25, 1995

[54] DEVICE FOR CONNECTING A COAXIAL CABLE END TO A CONTACT SOCKET

[75] Inventors: Friedbert Papenheim, Unna; Gerhard Feiler, Hagen, both of Germany

[73] Assignee: Raychem GmbH, Ottobrunn, Germany

[21] Appl. No.: 108,604

[22] PCT Filed: Mar. 16, 1992

[86] PCT No.: PCT/GB92/00467

§ 371 Date: Aug. 23, 1993

§ 102(e) Date: Aug. 23, 1993

[87] PCT Pub. No.: WO92/16985

PCT Pub. Date: Oct. 1, 1992

[30] Foreign Application Priority Data

Mar. 18, 1991 [DE] Germany ..... 41 08 755.0

[51] Int. Cl.[6] ..... H01R 13/621

[52] U.S. Cl. ..... 439/589; 439/320; 439/584

[58] Field of Search ..... 439/583, 584, 461, 462, 439/587, 589, 310, 320

[56] References Cited

U.S. PATENT DOCUMENTS

| | | | |
|---|---|---|---|
| 2,955,388 | 8/1961 | Morello, Jr. et al. | 439/583 |
| 2,986,720 | 5/1961 | Chess | 439/583 |
| 3,706,958 | 12/1972 | Blanchenot | 439/584 |
| 3,761,870 | 9/1973 | Drezin et al. | 439/584 |
| 3,936,124 | 2/1976 | Tuttle et al. | 439/279 |
| 3,985,950 | 10/1976 | Maltz | 439/874 |
| 4,151,364 | 4/1979 | Ellis | 174/84 C |

FOREIGN PATENT DOCUMENTS

| | | |
|---|---|---|
| 23880 | 7/1980 | European Pat. Off. . |
| 2325123 | 12/1973 | Germany . |
| 3141966 | 6/1982 | Germany . |
| 8219184 | 10/1982 | Germany . |
| 3230473 | 2/1984 | Germany . |
| 2238267 | 10/1984 | Germany . |
| 8424169 | 11/1984 | Germany . |
| 3511039 | 10/1986 | Germany . |
| 3512952 | 11/1986 | Germany . |
| 3607451 | 7/1988 | Germany . |
| 8407978 | 8/1984 | United Kingdom . |
| 2177552 | 1/1987 | United Kingdom . |

OTHER PUBLICATIONS

French Article, "La Paire Coaxiale de 7/27 mm" by Cazauk et al.

*Primary Examiner*—Gary F. Paumen

*Attorney, Agent, or Firm*—Herbert G. Burkard; William D. Zahrt, II; A. Stephen Zavell

[57] ABSTRACT

Device for connecting a coaxial cable end to a contact socket A device for connecting a coaxial cable end (2*a*) which may be provided with a cable end-plug (4) to a contact socket (3) comprises a further socket element (9) surrounding the contact socket (3), a seal (8) positioned between the further socket element (9) and the coaxial cable (2*a*), and a pressing element (11,12) which can deform the seal into contact with the coaxial cable (2*a*) and the further contact element (9). The device provides both a good seal, and strain relief to the completed connection.

13 Claims, 1 Drawing Sheet

DEVICE FOR CONNECTING A COAXIAL CABLE END TO A CONTACT SOCKET

BACKGROUND OF THE INVENTION

The invention relates to a device for connecting a coaxial cable end to a socket, and also for connecting a coaxial cable end, that is provided with a coaxial cable plug at its end, to a contact socket that at least partially covers the plug. The device preferably also provides a sealed and strain relieved connection.

Various methods and devices are known for connecting coaxial cable ends to sockets, either for connecting coaxial cable ends to each other or for introducing coaxial cables into sockets in housings. In these known methods and devices efforts are made not only to ensure the electrical connection, but also to make the connection point as secure as possible. The known methods and devices for connecting coaxial cable ends to sockets include methods and devices in which the coaxial cables are provided at their ends with coaxial cable end-plugs. These end-plugs have standard sized outer dimensions which enable standard sized sockets to accommodate a variety of different diameters of coaxial cables, since the plugs can than be used to make a connection between coaxial cables of different diameters on which they are placed and a corresponding counter-element in a contact socket of standard size. The contact socket for the coaxial cable or end-plug may be provided either at another cable end or in a housing such as a distribution box or the like.

As examples of the known methods and devices, there may be mentioned EP-0 023 880-A1, DE-22 38 267-C3, DE-23 25 123-B2, DE-31 41 966A1, DE-32 30 473-A, DE-35 11 039-A1 or DE-35 12 952-A1 of the Applicant.

Connection plugs for coaxial cables are also disclosed, for example, in DE-84 07 987-U1, DE-84 24 169-U1 or DE-82 19 184 of the Applicant, the latter disclosing, as does U.S. Pat. No. 4,151,364, a double-action coupling element for the direct connection of two cable ends.

It is also known to provide seals in the connection region of coaxial cables. DE-36 07 451-A1 of the Applicant, for example, discloses a coaxial cable end-plug in the form of connection body which can be placed over the coaxial cable end. The connection body is provided with an outer seal for resting against the inner surface of a socket piece to which the coaxial cable is to be connected, and an inner seal for resting against an inserted coaxial cable.

SUMMARY OF THE INVENTION

The present invention addresses the problem of making a universal connection for a coaxial cable-end to a contact socket, in which connection cable-end plugs may or may not be used, while ensuring that an excellent seal and also some strain relief are achieved in the completed connection.

A first aspect of the present invention provides a device for connecting a cut-back coaxial cable to a contact socket into which the coaxial cable is inserted, the device comprising:

(i) a further socket element that can be positioned, in use, to surround the contact socket;

(ii) a seal extending at least part of the way between the end surface of the contact socket and the end of the cut-back insulation on the coaxial cable and (iii) a pressing element which can act on the seal to deform the seal into contact with the inner surface of the further contact element and the outer surface of the inserted coaxial cable.

As used herein, the term a "cut-back coaxial cable" means a cable bared in the known standard way for connection to a contact socket or to another cable. A coaxial cable comprises an outer insulating jacket, an outer conductor, an intermediate insulating layer and an inner conductor. In a cut-back coaxial cable bared in the standard way, each of the layers surrounding the inner conductor is cut back increasingly larger distances from the end of the cable, to reveal a section of the layer underneath it. Thus a stepped configuration results in which the outer insulation jacket is cut back the furthest, and the inner insulating jacket the least.

The invention also provides a method of connecting a cut-back coaxial cable to a contact socket into which the coaxial cable is inserted, using a device according to the invention, the method comprising:

(i) positioning the device over the contact socket, and (ii) activating or moving the pressing element so that it acts on the seal to deform the seal between the inner surface of the further contact element and the outer surface of the inserted coaxial cable.

Preferably the cut back coaxial cable end is provided with a coaxial cable-end-plug and the seal extends from the end face of the plug that is towards the inserted coaxial cable at least as far as the cut back insulation of the coaxial cable.

The pressing element acts on the seal to deform the seal into contact with the inner surface of the further contact element and the outer surface of the inserted coaxial cable. Preferably the pressing element acts on an end face of the seal (preferably the outer end face facing towards the inserted coaxial cable), compressing the seal longitudinally so that it expands radially into contact with the said surfaces. To this end the other end of the seal preferably presses against a stop so that action of the pressing element does not simply urge the seal along the inner surface of the further socket element. This stop may be provided, as a separate element or be part of other elements of the device of the invention. For example if a cable end plug is provided it may be a stop shoulder on that cable end plug. As another example the seal may abut against part of the contact socket into which the coaxial cable is positioned.

The provision of a seal positioned as defined, in conjunction with the provision of a pressing element that deforms that seal, has a number of advantages. In particular an optimum seal is formed between the further socket element and the outer surface of the coaxial cable, so that no moisture is able to enter the region between the contact socket and the coaxial cable.

In one embodiment of the invention a screw thread is provided on the further socket element, preferably on the outer surface thereof, preferably at the free end thereof, and the pressing element is in the form of a union nut having a screw thread that co-operates with the thread on the further contact element. In one embodiment the pressing element also comprises pressing webs which act on the end face of the seal. The arrangement is preferably such that when the union nut is screwed onto the further contact socket the seal is simultaneously compressed longitudinally, by means of the pressing webs acting on the end face of the seal. The pressing webs may be integral with the union nut, or a separate part, for example webs depending from an annular ring. Where the webs are a separate part, this part may be urged longitudinally when the union nut is rotated, but not itself be rotated. The seal is thereby urged radially outward into sealing engagement with the further socket element and the coaxial cable end, i.e. into all free spaces in the coupling region of the coaxial cable in the contact socket.

In one preferred embodiment, the end surface of the further socket element slopes inwardly, thereby providing an inwardly directed continuous guide slope along which the pressing webs (that are preferably provided on the pressing element) can be guided. The pressing webs will thereby be guided to act laterally on the seal to compress it longitudinally, and will also be guided to press onto the outer surface (usually the plastics insulating jacket) of the coaxial cable.

In the preferred embodiment employing pressing webs acting on guide slopes at the end face of the further socket element, it is possible to arrange those pressing webs not only to compress the seal, but also at the same time to act as strain relief elements. This is achieved by arranging the pressing webs to point in a direction opposed to the direction of withdrawal of the coaxial cable, so that when a tensile strain is placed on the coaxial cable, withdrawal of the cable is substantially prevented by the pressing webs pressing onto the outer surface (usually the outer insulating jacket) of the coaxial cable.

In a particularly preferred embodiment involving the use of pressing webs, a thrust collar is preferably provided, which is arranged between the pressing webs and the seal so that the inner faces of the webs, towards the seal, act on the interposed thrust collar. In this manner it is possible to apply pressure to the entire outward facing surface of the seal, i.e. around a loop.

As stated above the pressing webs may be caused to press into the outer surface of the cables by acting on guide slopes on the end surface of the further socket element. Instead of providing guide slopes on the further socket element, similar guide slopes may be provided on a separate annular element positioned between the pressing webs and the seal. Where a thrust collar is provided the guide slopes may be provided on that collar, or on an additional element.

The contact socket into which the coaxial cable is inserted, and/or the further socket element, may be a coupling element at a free end of a second coaxial cable. The coupling element may, for example, couple the outer and inner conductors of the two coaxial cables. Alternatively the contact socket may comprise a cable entry pipe to a housing of an electrical device such as a distribution box or the like. The contact socket may form a mechanical coupling to the coaxial cable(s) or be heat recoverable, preferably heat shrinkable. Such contact jackets are well known and should be apparent to the man skilled in the art. The device of the present invention may include a contact socket as described herein.

The further socket element of the device of the invention, may be plastic. It can also be equipped with an external thread and/or can be heat shrinkable at least in regions, in order to facilitate connection to (e.g. shrinking down) onto the inserted coaxial cable end and/or onto a housing entry pipe or the like.

BRIEF DESCRIPTION OF THE DRAWINGS

The invention is described in detail below, by way of example, with reference to the drawings, in which.

DESCRIPTION OF THE PREFERRED EMBODIMENTS

Referring now to all the figures, a device according to the invention, generally designated 1, for connecting two coaxial cable ends 2*a* and 2*b* comprises a coupling-like contact socket 3 on one coaxial cable end 2*b*, and a coaxial cable end-plug 4 on the other coaxial cable end 2*a*.

Figure 4:
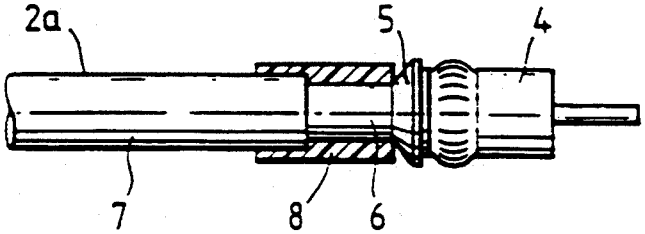
FIG. 4 shows the free end of the coaxial cable end 2*a* of FIGS. 1 and 3, that has been provided with a coaxial cable end-plug.

The coaxial cable plug 4 has at its one end towards the cable end 2*a*, a stop shoulder 5. This can be seen in FIG. 4. A seal 8, shown here as a sealing composition sleeve, extends from the stop shoulder 5 of the cable end-plug 4, over the outer conductor 6 of the coaxial cable 2*a*, as far as the cut back outer insulating jacket, designated 7, of the coaxial cable 2*a*.

Figure 1:
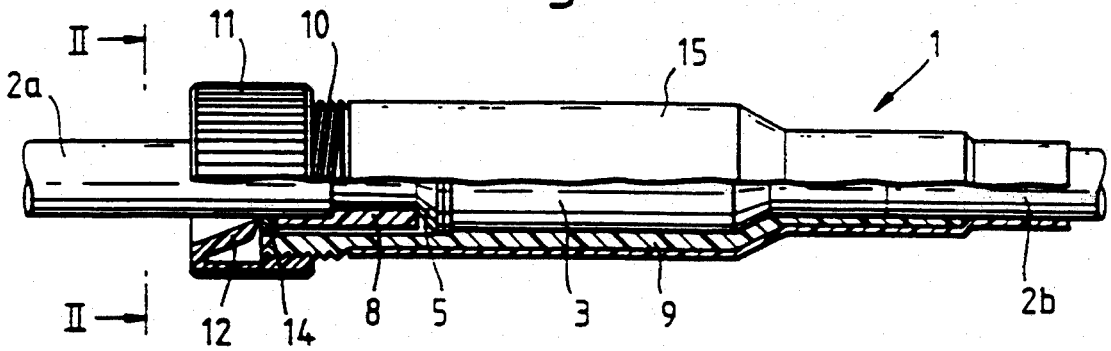
FIG. 1 is a partially cut-away view of two coaxial cables coupled to each other, in a position in which the two coaxial cable ends have not yet been secured to each other.
Figure 2:
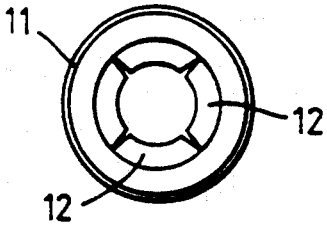
FIG. 2 is a view of the union nut shown in FIG. 1 approximately along the line II—II of FIG. 1.
Figure 3:
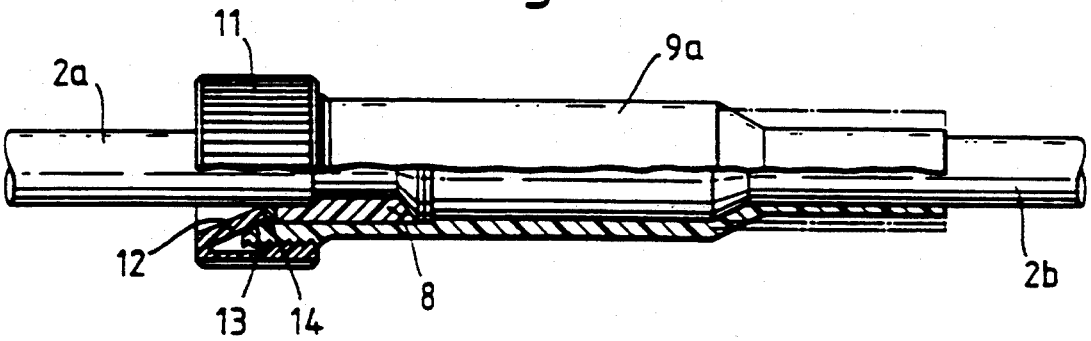
FIG. 3 is a view, corresponding to FIG. 1, of the coupling region in the secured position.

The contact socket 3 is surrounded by a plastics socket element 9 which, in the coupling position, projects so far over the inserted coaxial cable end 2*a* that the sealing composition sleeve 8 is completely covered by the plastics socket element 9, as will be seen from FIGS. 1 and 3.

At its free end (towards coaxial cable 2*a*), the further socket element 9 has an external thread 10 over which an internally threaded union nut 11 engages.

The union nut 11 constitutes the pressing element of the invention and to that end is equipped with inwardly pointing, slightly inclined pressing webs 12. The webs 12 rest against inwardly directed guide slopes 13 on the free end surface of the socket element 9. Between the pressing webs 12 and the sealing composition sleeve 8 there is additionally provided an annular thrust collar 14 which rests against the end face of the sealing composition sleeve 8 facing out towards the coaxial cable 2*a*.

The mode of operation is as follows:

The coaxial cable end plug 4 is positioned on the cut-back coaxial cable end 2*a*, and then pushed into the contact socket 3. The pressing element in the form of the union nut 11 is then screwed onto the external thread 10 of the further socket element 9. This causes the pressing webs 12 of the union nut 11 to press against the interposed thrust collar 14, i.e. to press in a direction to the right in FIG. 1. As the pressing webs 12 move to the right the inward-end faces of the webs 12 come to rest against the guide slopes 13. As screwing of the nut continues, the guide slopes 13 guide the pressing webs 12, in a sliding manner, towards the outer jacket of the coaxial cable 2*a*, so that not only is the thrust collar 14 pushed further to the right but also the free ends of the pressing webs 12 are pressed into the plastics insulating jacket of the coaxial cable end 2*a*, for example in the manner shown in FIG. 3. This means that not only is a sealing action achieved by means of the seal 8, but simultaneously strain relief of the connection is achieved.

As shown in FIG. 1 the further socket element 9 is surrounded by a piece of shrinkable tubing 15 and shrunk onto the coaxial cable end 2*b*. Instead the further socket element may itself be heat-shrinkable, at least in regions. A socket element 9*a* of that construction is shown in FIG. 3, the region to be shrunk being shown by a dot-dash line.

The described exemplary embodiments of the invention can, of course, still be modified in various respects without departing from the basic concept. For example, instead of being in the form of a sealing composition, the seal may be constructed as a deformable cylindrical sealing pipe, as a corrugated sealing pipe, as a combination of cylindrical or round sealing rings and so on.

The invention similarly relates, of course, to the possibility of coupling in cases where a cable plug is not required. This is especially the case when the diameter of the coaxial cable to be coupled is sufficiently large to be pushed directly into the contact socket 3. In this case, the seal 8 is supported on the end face of the contact socket 3, and the mode of operation is otherwise the same.

We claim:

1. A device for connecting a cut-back coaxial cable to a coaxial contact socket having a receiving end through which the coaxial cable is inserted and being electrically connected to an electrical device, comprising:

(i) a seal extending at least part of the way between the receiving end of the contact socket and the end of cut-back insulation on the coaxial cable, (ii) a further socket element surrounding the contact socket, projecting at least partially over said seal, and extending at least part of the way between the receiving end of the contact socket and the end of the cut-back insulation on the coaxial cable, (iii) a pressing element operatively associated with said seal for deforming said seal into contact with the inner surface of said further socket element and the outer surface of the coaxial cable, and (iv) a cable end-plug on the end of the cut-back coaxial cable, said cable end-plug mating with said contact socket, and wherein said seal extends from the end of said plug that is towards the inserted coaxial cable at least as far as the cut-back insulation of the coaxial cable.

2. A device according to claim 1 further comprising a thread at a receiving end of said further socket element, and wherein said pressing element further comprises pressing webs thereon for acting on the end of said seal to deform said seal into said contact with said further socket element inner surface and the coaxial cable outer surface.

3. A device according to claim 2 wherein said receiving end of said further socket element has an inwardly directed sloping surface which acts as a guide slope, and said pressing webs are configured for being pressed in sliding manner over said guide slope and onto the outer surface of the coaxial cable to deform said seal.

4. A device according to claim 2 further comprising an additional annular element between said seal and said pressing webs said annular element having an inwardly directed sloping surface which acts as a guide slope, and said pressing webs being configured for being pressed in sliding manner over said guide slope and onto the outer surface of the coaxial cable to deform said seal.

5. A device according to claim 2 wherein said pressing element is in the form of a nut incorporating said pressing webs, said nut being moveable relative to said further socket element to cause said pressing webs to act on the end of said seal.

6. A device according to claim 2 wherein said pressing element comprises a nut and said pressing webs, and wherein said pressing webs are moved longitudinally by said nut to act on said seal when said nut is moved relative to said further socket element.

7. A device according to claim 5 wherein said nut further comprises internal strew threads therein and wherein said thread at said receiving end of said further socket element is a screw thread on the outer surface of said further socket element which co-operates with said internal screw threads on said nut to effect said relative movement between said nut and said further socket element.

8. A device according to claim 2 wherein said pressing webs point in a direction opposed to the direction of withdrawal of the coaxial cable.

9. A device according to claim 1 wherein said further socket element is an engagement coupling element at an end of another coaxial cable.

10. A device according to claim 1 wherein said seal comprises a sealing composition sleeve.

11. A device according to claim 1 wherein at least part of said further socket element is formed of polymeric material.

12. A device according to claim 11 wherein at least part of said further socket element is heat recoverable, preferably heat shrinkable.

13. A method for connecting a cut-back coaxial cable to a coaxial contact socket having a receiving end through which the coaxial cable is inserted and which is electrically connected to an electrical device, comprising:

(i) positioning the cable in a seal extending at least part of the way between the receiving end of the contact socket and the end of cut-back insulation on the coaxial cable, the contact socket being surrounded by a further socket element projecting at least partially over the seal and extending at least part of the way between the receiving end of the contact socket and the end of the cut back insulation on the coaxial cable, (ii) activating a pressing element associated with the seal to deform the seal into contact with the inner surface of the further socket element and the outer surface of the inserted coaxial cable, (iii) the end of the coaxial cable being provided with a cable end-plug, the end-plug mating with the contact socket, and (iv) positioning the cable and end-plug so that the seal extends from the end of the plug that is towards the inserted coaxial cable at least as far as the cut-back insulation of the coaxial cable.

* * * * *